US006612122B1

(12) United States Patent
Wu

(10) Patent No.: US 6,612,122 B1
(45) Date of Patent: Sep. 2, 2003

(54) EXPANSION VALVE

(76) Inventor: Kuo-Chuan Wu, No. 806, Junghua Rd., Jungpu Shiang, Chiai (TW)

( * ) Notice: Subject to any disclaimer, the term of this patent is extended or adjusted under 35 U.S.C. 154(b) by 0 days.

(21) Appl. No.: 10/331,469

(22) Filed: Dec. 31, 2002

(51) Int. Cl.[7] ..... F25B 41/04
(52) U.S. Cl. ..... 62/224; 62/511; 62/474
(58) Field of Search ..... 62/224, 511, 527, 62/474; 236/92 B

(56) References Cited

U.S. PATENT DOCUMENTS 3,938,351 A * 2/1976 Schumacher ..... 62/217
4,255,940 A * 3/1981 Grahl et al. ..... 62/324.3
4,819,443 A * 4/1989 Watanabe et al. ..... 62/225
5,211,025 A * 5/1993 Ni et al. ..... 62/129
5,507,468 A * 4/1996 Evans ..... 251/118
5,553,460 A * 9/1996 Isaacs ..... 62/129
5,617,731 A * 4/1997 Scaringe ..... 62/149
6,106,596 A * 8/2000 Haramoto et al. ..... 96/135
6,330,810 B1 * 12/2001 Yamazaki et al. ..... 62/509
6,378,328 B1 * 4/2002 Cholkeri et al. ..... 62/528
6,395,074 B1 * 5/2002 Mastromatteo ..... 96/135
6,442,966 B1 * 9/2002 Wiser ..... 62/511

FOREIGN PATENT DOCUMENTS

JP 2000104675 * 4/2000

* cited by examiner

*Primary Examiner*—William E. Tapolcai
*Assistant Examiner*—Mohammad M. Ali
(74) *Attorney, Agent, or Firm*—Rosenberg, Klein & Lee

(57) ABSTRACT

An expansion valve has a tube body, in which a first filtering net, drying agents, a bullet-shaped filtering net, and a, reducing body are integrated. The tube body has front and rear ends respectively joined to an inlet tube, and an outlet tube. The first filtering net is disposed at the front end of the tube body. The drying agents are contained in a front portion of the tube body. The bullet-shaped filtering net is disposed in the drying agents. The reducing body is disposed in a rear portion of the tube body, and has an expansion hole, and front and fear reducing openings in communication with the expansion hole; the front and rear reducing openings are respectively joined to an enlarged end of the bullet-shaped filtering net, and the outlet tube.

1 Claim, 3 Drawing Sheets

EXPANSION VALVE

BACKGROUND OF THE INVENTION

1. Field of the invention

The present invention relates to an expansion valve, more particularly an expansion valve, which can be used in air-conditioners and refrigerating systems, and which has a filtering mechanism, dryers, and an expansion mechanism integrated therein.

2. Brief Description of the Prior Art

Conventionally, foods such as meats and vegetables are made dry with sunlight or pickled so that they can be preserved for extended period of time. With the advent of refrigerating systems, it is possible to preserve foods for relatively long time without use of conventional means of drying with sunlight and pickling. And, transportation of foods to distant locations is made feasible, allowing consumers to enjoy much bigger variety of foods. And, air-conditioners also contribute a lot towards improvement of mankind's life quality.

Either refrigerating machines or air-conditioning apparatuses have expansion valves fitted thereto for use in the refrigeration cycle thereof Referring to FIG. 4, a compressor 2, a high pressure pipe 21, a condenser 22, an expansion valve 23, an evaporator 24, and a low pressure pipe 25 are integrated in sequence to perform refrigerating cycles. In each refrigerating cycle, refrigerant is compressed by means of the compressor 2, and forced to travel into the condenser 22 via the high pressure pipe 21 to become pressured liquefied form, and then travels through the expansion valve 23 to go through the reduction and expansion process. After going through the expansion valve 23, the pressured liquefied refrigerant is transferred into the evaporator 24 to go through heat exchange process to provide cold for use. Finally, the refrigerant is forced to travel back into the compressor 2 via the low pressure pipe 25 by means of the compressor 2 for use in the next cycle. The expansion valve 23 is a very important part in the refrigeration cycle, and can be provided in various forms and dimensions according to needs. For example, capillaries can be substituted for expansion valves. In addition, a drying mechanism 26 can be arranged before the expansion valve 23 for absorbing water and impurities in refrigeration cycles.

However, the expansion valve 23 has disadvantages as followings:

1. Because additional filtering means and drying mechanisms have to be joined to the expansion valve 23, assembly of a refrigerating system will cost more labor and time. And, leakage of the whole refrigeration cycle is more likely to happen because additional joins are present due to additional filtering means and drying mechanisms.
2. When capillaries are used, it is relatively difficult to repair the capillaries because foamed fillers are usually used in the walls of air-conditioners and refrigerators as the lagging materials.
3. If filtration nets are arranged in front of capillaries, the capillaries are prone to get damaged or broken after long period of use due to vibration and friction of the filtration nets against the capillaries. And, conventional filtration nets can't effectively filter off water, impurities, and greasy dirt that comes out from compressor oil of the compressor 2 used at high temperature for a long period of time. Consequently, the refrigerating system can be blocked with the above substances, causing the compressor to burn or breakdown.

SUMMARY OF THE INVENTION

It is a main object of the present invention to provide an expansion valve of refrigerating systems, which has a filtration means, drying mechanisms, and an expansion mechanism integrated therein, so that it can function more efficiently.

The expansion valve has a tube body, in which a first filtering net, drying agents, a bullet-shaped filtering net, and a reducing body are integrated. The first filtering net is disposed over the front end of the tube body. The drying agents are contained in a front portion of the tube body. The bullet-shaped filtering net is disposed in the drying agents along the front portion of the tube body. The reducing body is disposed in a rear portion of the tube body, and is joined to both the bullet-shaped filtering net and a rear outlet end of the tube body.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
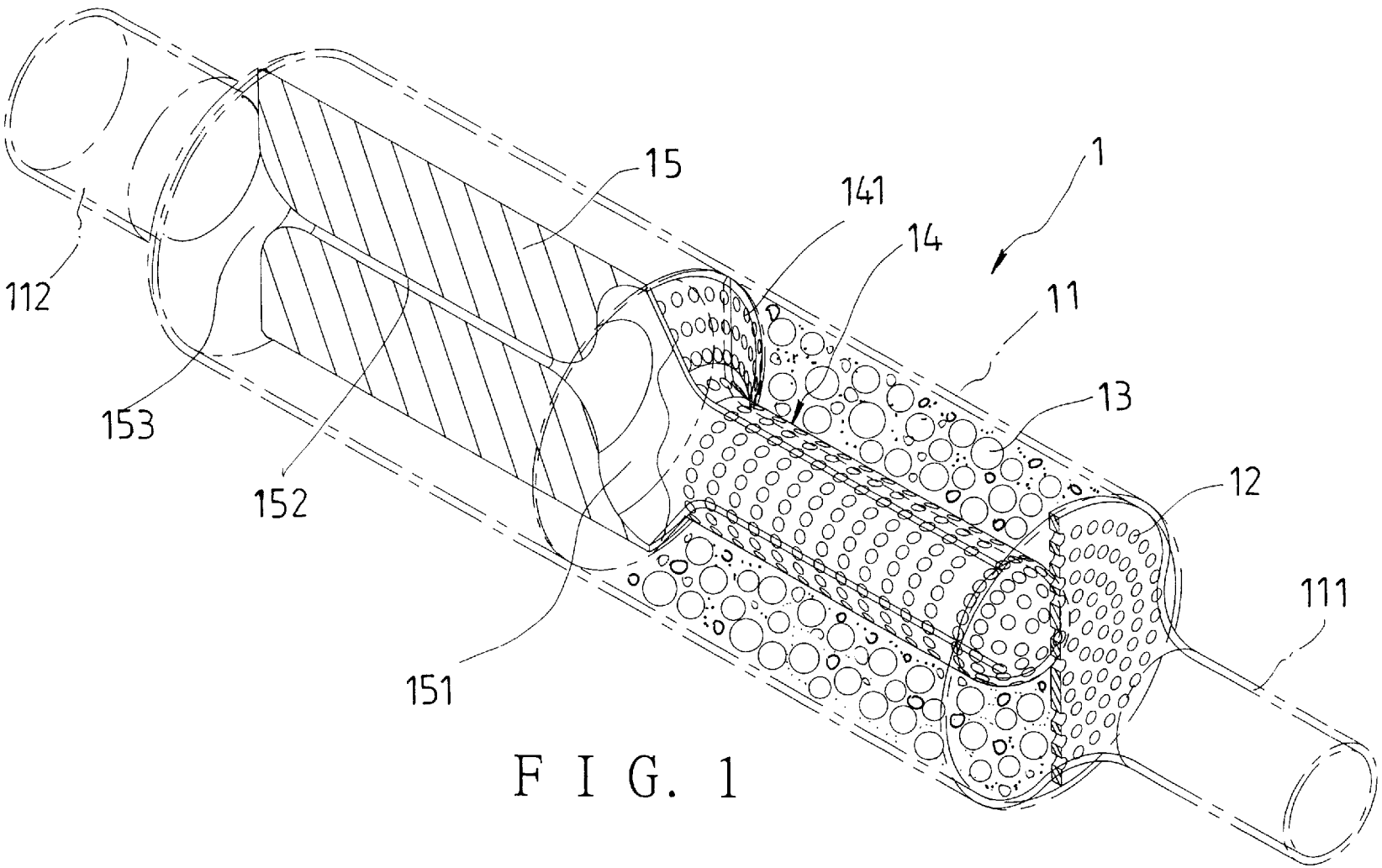
FIG. 1 is a perspective view of the expansion valve of refrigerating systems according to the present invention.
Figure 2:
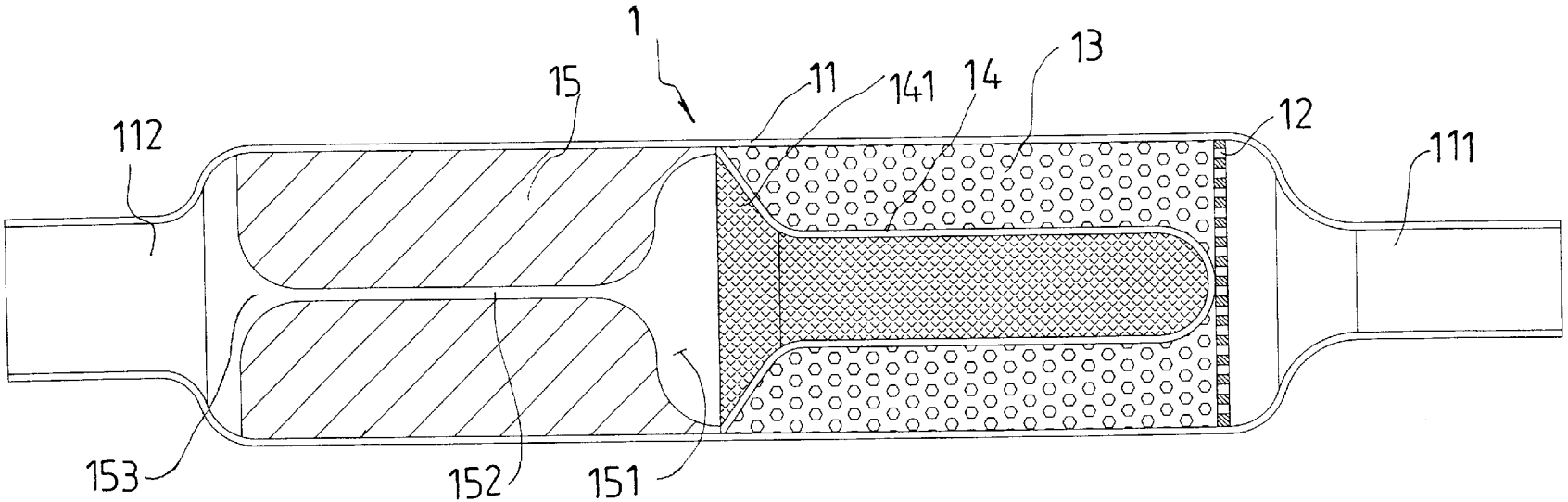
FIG. 2 is a cross-sectional view of the expansion valve of refrigerating systems according to the present invention.

Referring to FIGS. 1, and 2, an expansion valve 1 of the present invention includes a tube body 11, a filtering net 12, drying agents 13, a bullet-shaped filtering net 14, and a reducing body 15.

The tube body 11 has an inlet tube 111 connected to a front end thereof, and an outlet tube 112 connected to a rear end thereof; both the tubes 111 and 112 are thinner than the tube body 11, and the inlet tube 111 is thinner than the outlet tube 112. The inlet tube 111 and the outlet tube 112 are connected to a pipe of a refrigerating system.

The drying agents 13 are provided in the form of small grains. The filtering net 12 is like a round disk, and is disposed over the front end of the tube body 11. Then, the drying agents 13 are contained in the front portion of the tube body 11, and the bullet-shaped filtering net 14 is disposed in the drying agents 13 along the front portion of the tube body 11; the bullet-shaped filtering net 14 can be made of layers of filtration cottons, and inserted into the drying agents 13. The bullet-shaped filtering net 14 has an enlarged rear end 141 for connection with the reducing body 15.

The reducing body 15 is made by means of forming a relatively smooth expansion hole 152 through a solid material, and forming front and rear reduction openings 151, and 153 on a front end, and a rear end of the solid material respectively; the front and the rear reduction openings 151, 153 communicate with the expansion hole 152. The reducing body 15 is disposed in a rear portion of the tube body 11, and the front and the rear reduction openings 151, 153 are respectively joined to the enlarged end 141 of the bullet-shaped filtering net 14, and the rear end of the tube body 11 for the expansion hole 152 to communicate with the outlet tube 112. Thus, the front opening 151 communicates with the rear opening 153 and the outlet tube 112.

Figure 3:
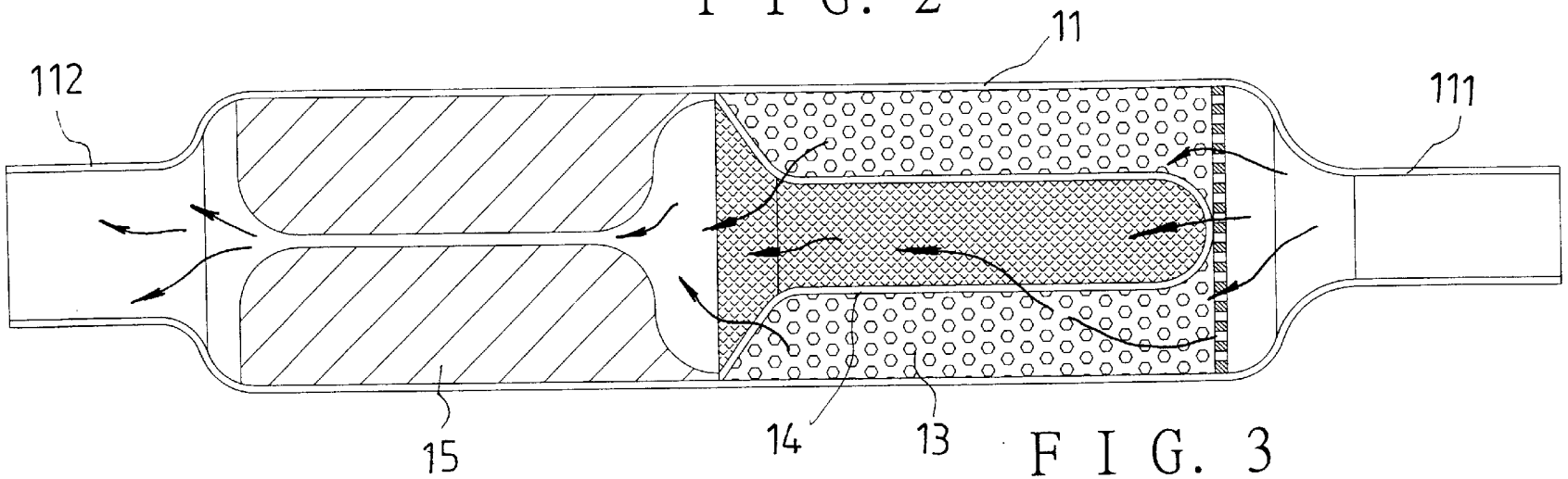
FIG. 3 is a cross-sectional view of the expansion valve of refrigerating systems in use according to the present invention; and, FIG. 4 is a diagram of a refrigeration cycle as described in the Background.
Figure 4:
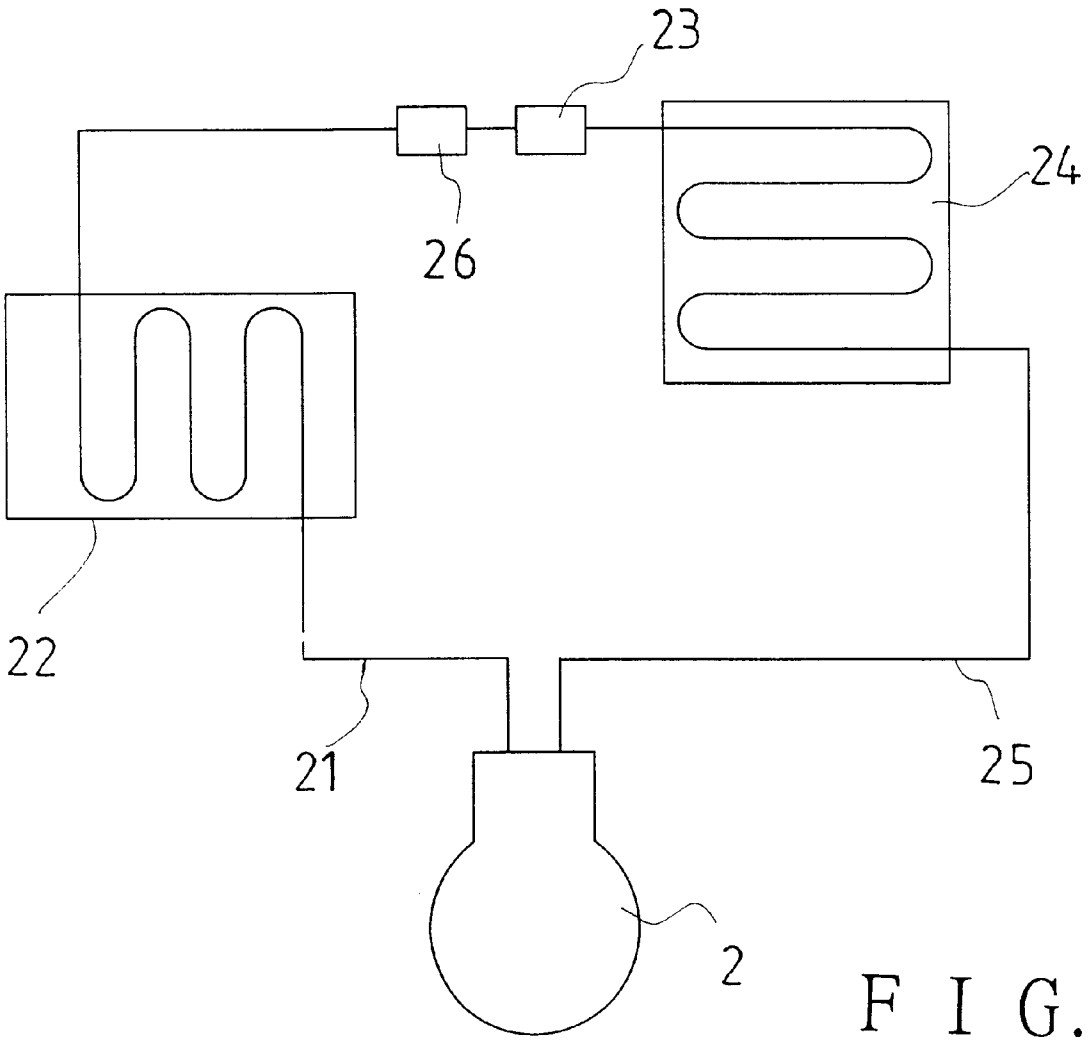
FIG. 4 (PRIOR ART)

Referring to FIG. 3, pressured liquefied refrigerant is forced to travel into the tube body 11 via the inlet tube 111 to go through a first expansion process, and for unwanted substances in the refrigerant, e.g. impurities and greasy dirt, to be filtered off by the filtering net 12. Then, the refrigerant travels through the drying agents 13 and the bullet-shaped filtering net 14 and into the tube body 11; thus, water is absorbed by means of the drying agents 13, and impurities and greasy dirt are filtered off more thoroughly. And, after going through the reduction and expansion process in the tube body 11, the refrigerant travels out of the outlet tube 112 into an evaporator (not shown) to go through heat exchange process to provide cold for use.

From the above description, it can be understood that the expansion valve of the present invention has advantages as followings:

1. The expansion valve is relatively small in size therefore it can be substituted for conventional capillaries used in small refrigerating systems such as air-conditioners and freezer refrigerators while having a better performance.
2. The expansion valve has expansion, filtering and drying functions integrated in it therefore it is convenient to use and possibility of leakage is reduced.
3. Besides having expansion, filtering and drying functions integrated in it, the expansion valve allows refrigerant to go through multi reduction and expansion processes therefore the refrigerant can absorb heat more efficiently.
4. The tube body 11 can be joined to the tubes 11, 112 by means of welding, and can be formed to have a megaphone-shape at two ends if need be. And, the filtering net 12 can prevent the drying agents 13 from flowing through the inlet tube 111 to cause blockage of the pipe.
5. The drying agents 13 in the form of small grains can get rid of water and acid substance in the pipe effectively to prevent the whole system from being interfered.
6. The bullet-shaped filtering net 14 is held deep in the drying agents 13, and can provide a filtration area several times bigger than that of conventional plane filtering nets therefore blockage of the pipe is effectively prevented.
7. The expansion hole 152 of the reducing body is relatively smooth. And, expansion valves are made with expansion holes of different diameters so that they can be chosen for use according to pressure and flow rate of refrigerant in refrigerating systems. Therefore, blockage or breakage can't occur in the expansion hole.

What is claimed is:

1. An improvement on expansion valve, comprising a tube body having front and rear ends respectively joined to an inlet tube, and an outlet tube thicker than the inlet tube;

a first filtering net disposed over the front end of the tube body;

drying agents contained in a front portion of the tube body;

a bullet-shaped filtering net disposed in the drying agents; and, a reducing body disposed in a rear portion of the tube body; the reducing body having an expansion hole, and front and rear reducing openings at two ends thereof and in communication with the expansion hole; the front and rear reducing openings being respectively joined to an enlarged end of the bullet-shaped filtering net, and the outlet tube at the rear end of the tube body.

* * * * *